US008188682B2

(12) United States Patent
Nalbant

(10) Patent No.: US 8,188,682 B2
(45) Date of Patent: May 29, 2012

(54) HIGH CURRENT FAST RISE AND FALL TIME LED DRIVER

(75) Inventor: Mehmet Nalbant, Cupertino, CA (US)

(73) Assignee: Maxim Integrated Products, Inc., Sunnyvale, CA (US)

( * ) Notice: Subject to any disclaimer, the term of this patent is extended or adjusted under 35 U.S.C. 154(b) by 494 days.

(21) Appl. No.: 11/767,400

(22) Filed: Jun. 22, 2007

(65) Prior Publication Data

US 2008/0012507 A1 Jan. 17, 2008

Related U.S. Application Data

(60) Provisional application No. 60/819,049, filed on Jul. 7, 2006.

(51) Int. Cl.
*H05B 37/02* (2006.01)

(52) U.S. Cl. ..... 315/306; 315/193; 315/300

(58) Field of Classification Search ..... 315/192, 315/193, 209 R, 224–226, 291, 300–303, 315/306–307

See application file for complete search history.

(56) References Cited

U.S. PATENT DOCUMENTS

| | | | | |
|---|---|---|---|---|
| 3,292,579 | A | 12/1966 | Buchanan | 119/5 |
| 3,611,021 | A | 10/1971 | Wallace | 315/239 |
| 3,671,782 | A | 6/1972 | Wittlinger et al. | 307/238 |
| 3,758,823 | A | 9/1973 | Jett et al. | 315/219 |
| 3,772,625 | A | 11/1973 | Raupach | 336/94 |
| 3,778,677 | A | 12/1973 | Kriege | 315/219 |
| 3,810,026 | A | 5/1974 | Roth | 328/127 |
| 3,828,203 | A | 8/1974 | Belson et al. | 307/228 |
| 3,840,795 | A | 10/1974 | Roszyk et al. | 320/2 |
| 3,893,036 | A | 7/1975 | Cavoretto et al. | 328/185 |
| 3,921,005 | A | 11/1975 | Watrous | 307/64 |
| 3,953,768 | A | 4/1976 | Meredith et al. | 317/31 |
| 4,030,058 | A | 6/1977 | Riffe et al. | 336/92 |
| 4,031,449 | A | 6/1977 | Trombly | 320/2 |
| 4,127,795 | A | 11/1978 | Knoll | 315/210 |
| 4,163,923 | A | 8/1979 | Herbers et al. | 315/208 |
| 4,172,981 | A | 10/1979 | Smith | 307/66 |
| 4,207,498 | A | 6/1980 | Spira et al. | 315/97 |
| 4,210,846 | A | 7/1980 | Capewell et al. | 315/121 |
| 4,225,825 | A | 9/1980 | Watts | 328/185 |
| 4,251,752 | A | 2/1981 | Stolz | 315/206 |
| 4,260,943 | A | 4/1981 | Zaderej et al. | 320/21 |
| 4,277,726 | A | 7/1981 | Burke | 315/98 |

(Continued)

FOREIGN PATENT DOCUMENTS

DE 32 33 655 A1 5/1983

(Continued)

OTHER PUBLICATIONS

Braun et al., "Electroluminescence and Electrical Transport in Poly(3-octylthiophene) Diodes," *Journal of Applied Physics*, vol. 72, Abstract, Jul. 15, 1992.

(Continued)

*Primary Examiner* — Tung X Le
(74) *Attorney, Agent, or Firm* — Haverstock & Owens LLP

(57) ABSTRACT

The present invention contemplates a variety of improved techniques for the fast switching of current through, among others, LED loads. A current shunting device is utilized to divert current away from a load at high speed when activated, thus enabling the control of the amount current that flows through the load.

26 Claims, 7 Drawing Sheets

U.S. PATENT DOCUMENTS 4,277,728 A 7/1981 Stevens ..... 315/307
4,297,614 A 10/1981 Chandler ..... 315/86
4,318,608 A 3/1982 Payne ..... 355/3
4,390,844 A 6/1983 Ting ..... 328/142
4,412,265 A 10/1983 Buuck ..... 361/18
4,414,493 A 11/1983 Henrich ..... 315/308
4,441,053 A 4/1984 Daspit ..... 315/206
4,441,054 A 4/1984 Bay ..... 315/219
4,453,109 A 6/1984 Stupp et al. ..... 315/219
4,486,689 A 12/1984 Davis et al. ..... 315/92
4,495,446 A 1/1985 Brown et al. ..... 315/206
4,496,896 A 1/1985 Melocik et al. ..... 320/2
4,498,031 A 2/1985 Stupp et al. ..... 315/307
4,523,131 A 6/1985 Zansky ..... 315/307
4,528,482 A 7/1985 Merlo ..... 315/291
4,566,134 A * 1/1986 Harbour et al. ..... 398/164
4,572,988 A 2/1986 Handler et al. ..... 315/209 R
4,585,974 A 4/1986 Stupp et al. ..... 315/307
4,604,552 A 8/1986 Alley et al. ..... 315/176
4,612,479 A 9/1986 Zansky ..... 315/194
4,654,573 A 3/1987 Rough et al. ..... 320/2
4,686,427 A 8/1987 Burke ..... 315/219
4,698,554 A 10/1987 Stupp et al. ..... 315/307
4,700,113 A 10/1987 Stupp et al. ..... 315/224
4,704,563 A 11/1987 Hussey ..... 315/307
4,717,863 A 1/1988 Zeiler ..... 315/307
4,723,098 A 2/1988 Grubbs ..... 315/306
4,739,277 A 4/1988 Hollister et al. ..... 328/55
4,763,239 A 8/1988 Ball ..... 363/98
4,775,820 A 10/1988 Eguchi et al. ..... 313/504
4,800,328 A 1/1989 Bolger et al. ..... 320/2
4,806,880 A 2/1989 Laws ..... 331/8
4,874,989 A 10/1989 Nilssen ..... 315/151
4,893,059 A 1/1990 Nilssen ..... 315/127
4,896,077 A 1/1990 Dodd et al. ..... 315/289
4,920,299 A 4/1990 Presz et al. ..... 315/98
4,935,669 A 6/1990 Nilssen ..... 315/105
4,942,352 A 7/1990 Sano ..... 320/2
4,952,849 A 8/1990 Fellows et al. ..... 315/307
4,962,344 A 10/1990 Bohrer ..... 307/260
5,015,919 A 5/1991 Vila-Masot et al. ..... 315/86
5,045,732 A 9/1991 Sugiura et al. ..... 307/529
5,048,033 A 9/1991 Donahue et al. ..... 372/38
5,049,790 A 9/1991 Herfurth et al. ..... 315/291
5,104,749 A 4/1992 Sato et al. ..... 428/690
5,111,118 A 5/1992 Fellows et al. ..... 315/307
5,177,408 A 1/1993 Marques ..... 315/291
5,202,608 A 4/1993 Johnson ..... 315/86
5,214,352 A 5/1993 Love ..... 315/86
5,237,242 A 8/1993 Takahashi et al. ..... 315/123
5,363,020 A 11/1994 Chen et al. ..... 315/209 R
5,367,223 A 11/1994 Eccher ..... 315/97
5,367,224 A 11/1994 Pacholok ..... 315/219
5,367,242 A 11/1994 Hulman ..... 320/2
5,384,516 A 1/1995 Kawabata et al. ..... 315/160
5,394,020 A 2/1995 Nienaber ..... 327/140
5,408,162 A 4/1995 Williams ..... 315/224
5,410,188 A 4/1995 Segaram ..... 327/237
5,410,221 A 4/1995 Mattas et al. ..... 315/307
5,615,093 A 3/1997 Nalbant ..... 363/25
5,642,066 A 6/1997 Burke ..... 327/132
5,652,479 A 7/1997 LoCascio et al. ..... 315/225
5,736,881 A * 4/1998 Ortiz ..... 327/175
5,754,012 A 5/1998 LoCascio et al. ..... 315/307
5,767,631 A * 6/1998 Konopka et al. ..... 315/307
5,818,669 A 10/1998 Mader ..... 361/18
5,844,378 A 12/1998 LoCascio et al. ..... 315/307
5,965,241 A 10/1999 Mehta ..... 428/195
5,965,989 A 10/1999 Mader ..... 315/279
6,320,330 B1 * 11/2001 Haavisto et al. ..... 315/291
6,392,358 B1 * 5/2002 Runau et al. ..... 315/185 R
6,697,402 B2 * 2/2004 Crawford ..... 372/38.03
6,798,372 B1 9/2004 Yang et al. ..... 341/157
6,807,209 B2 10/2004 Martinez et al. ..... 372/38.02
6,859,473 B1 2/2005 Tan ..... 372/38.02
7,402,961 B2 * 7/2008 Bayat et al. ..... 315/295
7,439,945 B1 * 10/2008 Awalt et al. ..... 345/83
7,545,369 B1 6/2009 Lan et al.
7,626,340 B2 * 12/2009 Kang et al. ..... 315/209 R
2003/0016711 A1 * 1/2003 Crawford ..... 372/38.02
2004/0036990 A1 * 2/2004 Hanano ..... 359/831
2005/0073263 A1 4/2005 Havlik et al.
2005/0156536 A1 7/2005 Ball
2005/0162098 A1 7/2005 Ball
2005/0243022 A1 * 11/2005 Negru ..... 345/46
2007/0164686 A1 * 7/2007 Ribarich et al. ..... 315/274
2007/0257623 A1 * 11/2007 Johnson et al. ..... 315/193
2007/0262724 A1 * 11/2007 Mednik et al. ..... 315/125
2008/0031014 A1 * 2/2008 Young ..... 363/16
2008/0117649 A1 5/2008 Tanaka et al.
2010/0315572 A1 12/2010 LoCascio

FOREIGN PATENT DOCUMENTS

DE 34 32 266 A1 3/1985
WO WO 90/13148 11/1990
WO WO 92/01334 1/1992
WO WO 00/59064 10/2000
WO WO 01/78852 A1 10/2001

OTHER PUBLICATIONS

Chen and Rieke, "The First Regloregular Head-to-Tail Poly (3-hexylthiophene-2,5diyl) and a Regiorandom Isopolymer: Ni vs Pd Catalysis of 2(5)-Bromo-5(2)-(bromozincio)-3-hexylthiophene Polymerization," *J. Am. Chem. Soc.*, 114, pp. 10087-10088, Aug. 3, 1992.

McCullough, Richard D. and Renae D. Low, "Enhanced Electrical Conductivity in Refioselectively Synthesized Poly(3-alkylthiophenes)," *J. Chem. Soc., Chem. Commun.*, pp. 70-72., 1992.

Ohmori, Yutaka, Masao Uchida, Keiro Muro and Katsumi Yoshino, "Visible-Light Electroluminescent Diodes Utilizing Poly (3-alkylthiophene)," *Japanese Journal of Applied Physics*, vol. 30, No. 11B, pp. L1938-L1940, Sep. 21, 1991.

Ohmori, Yutaka, Masao Uchida, Keiro Muro and Katsumi Yoshino, "Effects of Alkyl Chain Length and Carrier Confinement Layer on Cjaracteristics of Poly (3-alkylthiophene) Electroluminescent Diodes," *Solid State Communications*, vol. 80, No. 8, pp. 605-608, 1991.

"Advance Information ML-4830 Electronic Ballast Controller", *Micro Linear*, pp. 1-8, Jun. 1992.

"Advance Information ML-4830 Electronic Ballast Controller", *Micro Linear*, pp. 1-4, Jul. 1992.

Williams, J., "Techniques for 92% Efficient LCD Illumination," *Linear Technology Application Note 55*, pp. AN55-1-AN55-43, Aug. 1993.

"ML4874 LCD Backlight Lamp Driver," *Micro Linear*, pp. 1-6, Apr. 1994.

"ML4876 LCD Backlight Lamp Driver with Contrast," *Micro Linear*, pp. 1-6, Apr. 1994.

Mader, Urs, K. Kit Sum, and Jim LoCascio, "Application Note 26-Power Conversion Efficiencies for Miniature Fluorescent Lamp," *Micro Linear*, pp. 1-6, Feb. 1994.

Sum, Kit K. and Urs Mader, "Application Note 32-Theory and Application of the ML4874 and ML 4876 LCD Backlight Controller ICs," *Micro Linear*, pp. 1-12, Jun. 1994.

LoCascio, James J. and U.H. Mader, "A New Control Technique Uses 25% Less Power to Drive Miniature Cold Cathode Fluorescent Lamps," *Electronic Ballast*, pp. 60-69, Apr. 1994.

Jordan, Mark and J.A. O'Connor, "Resonant Fluorescent Lamp Converter Provides Efficient and Compact Solution," *IEEE*, pp. 424-431, 1993.

"CCFT Backlight and LCD Contrast Controllers—MAX753/MAX754,"*Maxim Integrated Products*, pp. 1-12, Feb. 1994.

Sum, Kit K., "ML4874 Evaluation Kit User's Guide—LCD Backlight Lamp Driver," *Micro Linear*, pp. 1-5, Apr. 1994.

"ML4864 Evaluation User's Guide—LCD Backlight Lamp Driver with Contrast Control," Micro Linear, pp. 1-4, Jan. 1994.

"ML4864 LCD Backlight Lamp Driver with Contrast Control," *Micro Linear*, pp. 1-6, Nov. 1993.

* cited by examiner

HIGH CURRENT FAST RISE AND FALL TIME LED DRIVER

RELATED APPLICATIONS

The present application claims priority to and is a utility patent application of Nalbant's U.S. Provisional Application No. 60/819,049, filed Jul. 7, 2006, entitled HIGH CURRENT FAST RISE AND FALL TIME LED DRIVERS, which is hereby incorporated by reference.

BACKGROUND

1. Field of Invention

This invention relates to the field of high current LED driver.

2. Background of the Invention

High brightness and high current light emitting diodes (LED) are increasingly being used as high intensity light sources. High intensity LEDs provide many benefits over other high intensity light sources, such as longer life, wider color range, less hazardous operating voltages, and higher efficiency. In some rear projection TVs and front projection systems the light from an LED is required to be switched very rapidly as required by the Digital Micromirror Device (DMD).

The digital micromirror device (DMD) imager is a digital light valve that either reflects or deflects a light source. Color images are formed by sequentially shining the DMD with a Red, Green and Blue light source and by temporal modulation of the intensity of the light reflected from each DMD pixel. Because of this fast modulation the DMD imager requires a red, blue, and green LED to be switched on and off very fast which necessitates the LED current to be switched ON and OFF very fast. The current switching required has been difficult with conventional means. In the past the switching of current to an LED was accomplished by charging and discharging the inductor in a switching regulator. In this case switching regulators with high efficiency are highly desirable to prevent excessive power loss as a result of switching several amperes of current. This suffers from many shortcomings, most importantly the difficulty in switching the current as quickly as needed.

The foregoing examples of the related art and limitations related therewith are intended to be illustrative and not exclusive. Other limitations of the related art will become apparent to those of skill in the art upon a reading of the specification and a study of the drawings.

SUMMARY OF THE INVENTION

The present invention contemplates a variety of improved techniques for the fast switching of high amplitude current. A current shunting device can be utilized to divert a high amplitude current away from a load at high speed when activated, thus enabling the control of the amount current that flows through the load. These and other advantages of the present invention will become apparent to those skilled in the art upon a reading of the following descriptions and a study of the several figures of the drawings.

BRIEF DESCRIPTION OF DRAWINGS

These and other objects, features and characteristics of the present invention will become more apparent to those skilled in the art from a study of the following detailed description in conjunction with the appended claims and drawings, all of which form a part of this specification. In the drawings:

DETAILED DESCRIPTION OF THE INVENTION

In the following description, several specific details are presented to provide a thorough understanding of embodiments of the invention. One skilled in the relevant art will recognize, however, that the invention can be practiced without one or more of the specific details, or in combination with other components, etc. In other instances, well-known implementations or operations are not shown or described in detail to avoid obscuring aspects of various embodiments, of the invention.

Figure 1:
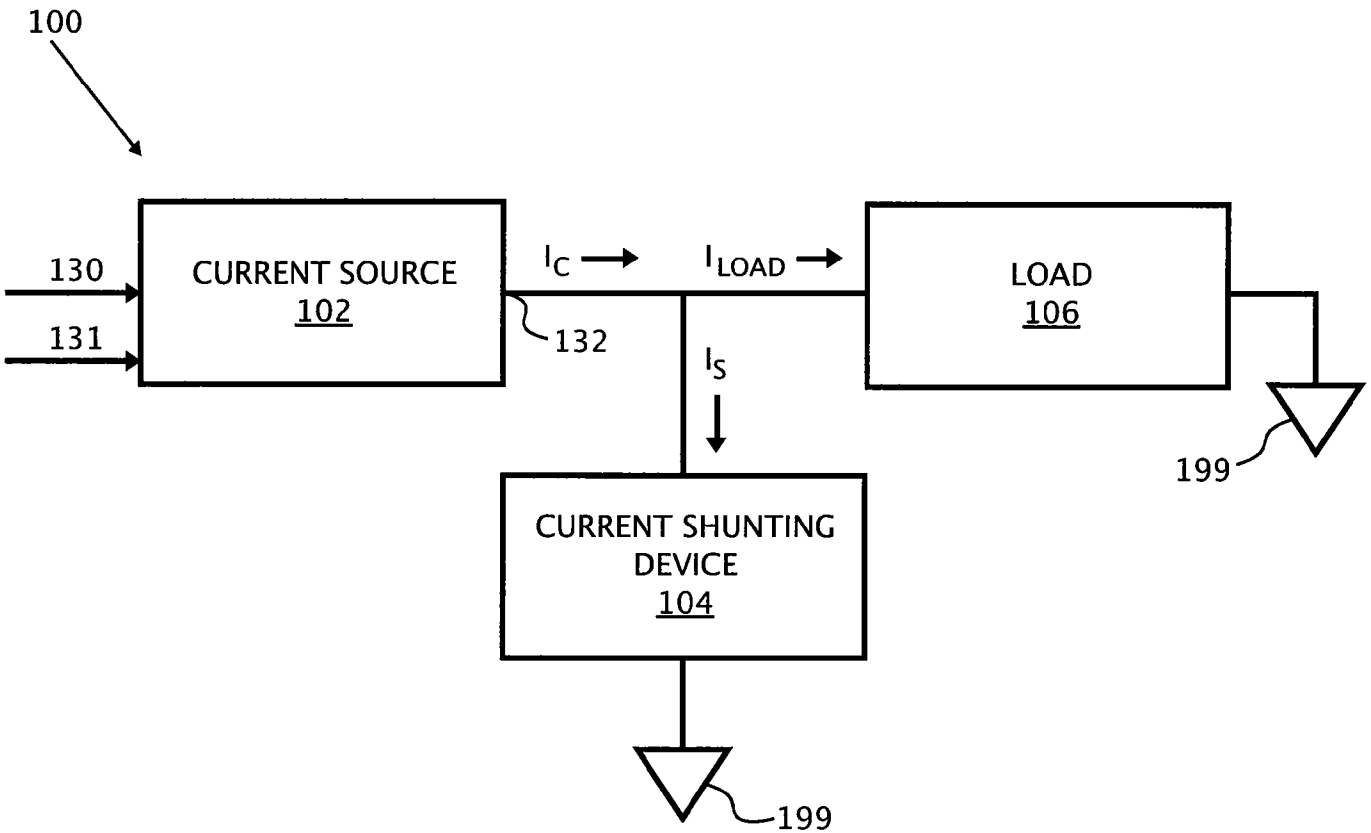
FIG. 1 is an exemplary block diagram of a high current fast rise and fall time load driver according to one embodiment of the present invention.

FIG. 1 is an exemplary block diagram of a high current fast rise and fall time load driver 100 according to one embodiment of the present invention. The load driver 100 includes current source 102, and one or more current shunting device 104 which is parallel coupled with a load 106 to a common ground 199. The current source 102 is a controlled current $I_C$ which may be in parallel with the current shunting device 104 and the load 106. An output 132 of the current source 102 is a controlled current $I_C$ which may drive the current shunting device 104 and the load 106 with a substantially constant current. The ON and OFF operation (activate or deactivate) of the current shunting device 104 may be controlled by an input signal 130 to the current source 102 from accompanying devices, circuitries and/or systems, e.g., by a video control signal derived from a source such as a video processor or a high speed pulse train. Another input 131 to the current source can be used to adjust the amplitude of the controlled current $I_C$. The controlled current $I_C$ may be switched away from the load 106 at high speed by shunting the controlled current $I_C$ through the current shunting device 104.

In some example embodiments, the current shunting device 104 may shunt substantially all of current $I_C$ when the current shunting device is activated, making $I_S$ substantially equal to $I_C$ and $I_{LOAD}$ substantially equal to zero. When the current shunting device 104 is not activated the current shunting device 104 shunts substantially none of the current $I_C$, making $I_C$ substantially equal to $I_{LOAD}$. In an example embodiment, the current shunting device 104, when activated, may shunt only a portion of $I_C$. The current shunting device 104 may vary in resistance and the resistance may be controlled by accompanying devices, circuitries and/or systems, e.g., by a video control signal derived from a source such as a video processor or a high speed pulse train. Depending on the resistance value of the current shunting device 104, $I_S$ and $I_{LOAD}$ may both be greater than zero, so long as $I_C$ is greater than zero.

In some example embodiments, the current source 102 includes an inductor. The inductor and its associated switching circuitry may be kept in a charged state, and may supply the substantially stable current, $I_C$. The inductor may also be charged and discharged while in operation, which may result in a varying current source, $I_C$, rather than a substantially stable current. Discharging the inductor may be used in combination with shunting the current $I_C$.

In some example embodiments, the shunting device 104 includes a switch, which can be but is not limited to, a low impedance metal oxide semiconductor field-effect transistor (MOSFET), an insulated-gate field-effect transistor (IGFET), or a bipolar junction transistor (BJT). In the case of MOSFET, for a non-limiting example, the use of a MOSFET in the current shunting device 104 may require a voltage difference to be applied across the source and gate on the MOSFET. The voltage difference may be varied, and may result in the impedance of the MOSFET being varied. The MOSFET may also be used digitally where the voltage difference is varied between two states, one to divert substantially all of a current, and a second to divert substantially none of the current.

In some example embodiments, the load 106 is any device and/or system known or convenient. The load 106 may have substantially constant or varying impedance. In some exemplary embodiments the load 106 is coupled to a ground source such as ground 199. An example load 106 includes a light emitting diode (LED) or a string of LEDs. The load driver 100 may switch the LED or LEDs rapidly and may allow high amplitude current to be switched in sub-microseconds time. In some example embodiments, a LED may be switched in less than 2 μsecs.

Figure 3:
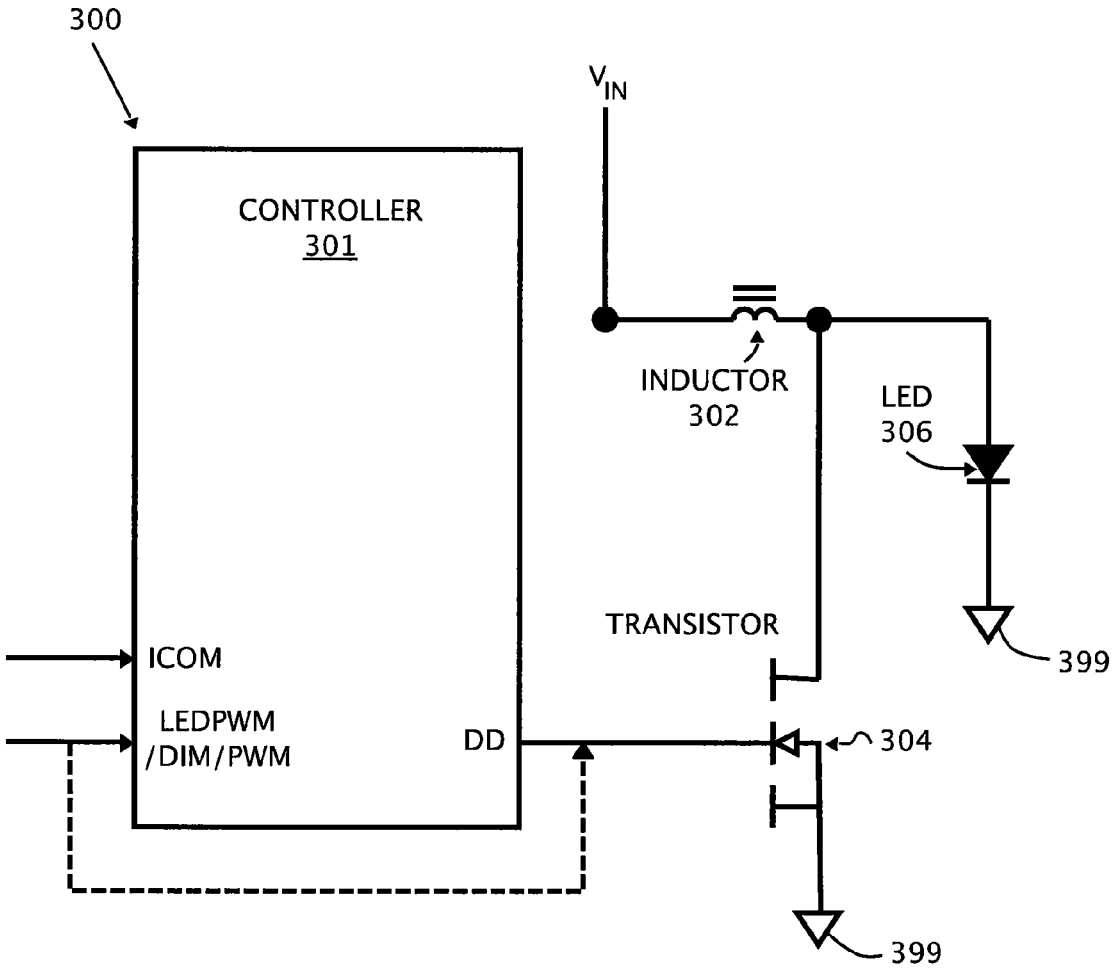
FIG. 3 is an exemplary diagram of a high current fast rise and fall time load driver according to one embodiment of the present invention.

In some example embodiments, the high current fast rise and fall time load driver 100 may have synchronous rectification 105 in FIGS. 1 and 305 in FIG. 3. Synchronous rectification may be achieved by including a diode and a transistor in parallel. In an exemplary operation, synchronous rectification may reduce voltage drop because when the diode is forward-biased, the transistor is closed and thereby reduces the voltage drop. When the diode is reverse-biased, the transistor is open. In some example embodiments, the transistor used may be a MOSFET. Synchronous rectification is not required but may be advantageous in some embodiments.

In some example embodiments, a freewheeling diode 307 in FIG. 3 can be used to provide a path for the release of energy stored in the load when the load voltage drops to zero. The freewheeling diode helps to prevent damage to circuit components caused by the energy stored in the load in case such energy arcs across the contacts of the switch when the switch is opened.

Figure 2:
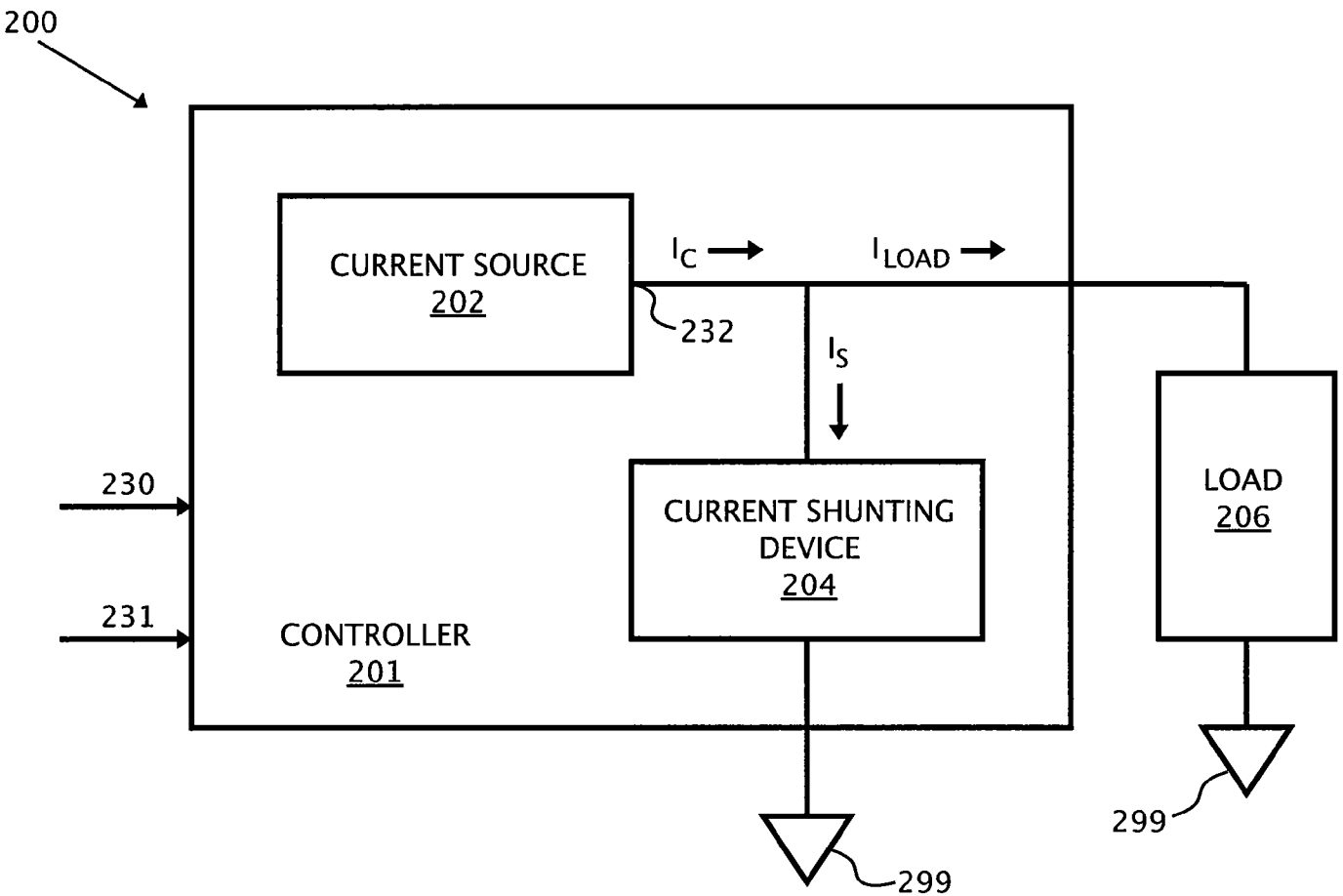
FIG. 2 is an exemplary block diagram of a high current fast rise and fall time load driver according to one embodiment of the present invention.

FIG. 2 is an exemplary block diagram of a high current fast rise and fall time load driver 200 according to one embodiment of the present invention. The load driver 200 includes a controller (a controlling circuit/power circuit) 201, a current source 202, and a current shunting device 204 which is parallel coupled with a load 206 to a common ground 299. The controller 201 may be an integrated circuit (IC) including both the current source 202 and the current shunting device 204. An output 232 of the current source 202 is a controlled current $I_C$ which may drive the parallel coupled low impedance current shunting device 204 and the load 206 with a substantially constant current. The ON/OFF operation of the current shunting device 204 may be controlled by an input signal 230 to the controller 201 accompanying devices, circuitries or systems, for example, by a video control signal derived from a source such as a video processor or a high speed pulse train. Another input 231 to the controller 201 can be used to adjust the amplitude of the controlled current $I_C$. The current $I_C$ may be applied to the load 106 or switched away from the load 106 by shunting the controlled current $I_C$ through the current shunting device 104. The load 206 may be external to the controller 201. In some example embodiments the load 206 and controller 201 are on the same IC or printed circuit board (PCB). In other example embodiments the load 206 is not on the same IC or PCB as the controller 201 and may be coupled to the controller 201 in any manner known and convenient (i.e. wires, etc.).

FIG. 3 is an exemplary diagram of a high current fast rise and fall time load driver 300 according to one embodiment of the present invention. The load driver 300 includes a controller 301, an inductor 302, and a switching transistor 304 which is parallel coupled with a light emitting diode (LED) 306 and a common ground 399. The controller 301 includes a DD pin, which is coupled to the switching transistor 304 and may activate and de-activate the switching transistor 304, thereby diverting the current supplied from the inductor 302 away from the LED 306. The DD pin may control activation of the switching transistor 304 by varying the DD pin voltage value. The controller 301 may be implemented in any manner known or convenient, for example as an integrated circuit (IC), and in some example embodiments will include additional pins for increased functionality. The inductor 302 may be any inductor known or convenient. The inductor 302 is charged by a voltage source through the switching transistor 304. It controls the ripple current and opposes changes in currents when charged, and thus provides a substantially stable current so long as the inductor is charged.

In some example embodiments, the required and/or preferred properties of the inductor 302 will vary the operating requirements of the load driver 300. For example, switching frequency, peak inductor current and allowable ripple at the output may determine the inductance value and size of the inductor 302. In general, selecting higher switching frequencies reduces the inductance requirement of the inductor 302 but will result in a lower efficiency. Also, the charging and discharging cycle of the inductor 302 and the drain capacities in the switching transistor 304 may create switching losses. In some example embodiments, lower switching frequencies should be used to reduce switching losses.

The switching transistor 304 may be any transistor known or convenient. In some example embodiments, a MOSFET may be used. The MOSFET may operate as a gate or shunting device, allowing substantially zero current across the source and drain terminals when inactive. If a MOSFET is used as the switching transistor 304, an input pin named LEDPWM or DIM or PWM to controller 301 is operable to control the ON and OFF sequence of 304 via the DD pin on controller 301, where DD may activate the MOSFET by the voltage applied on the gate terminal. Alternatively, the control signal may come directly from a control system without first being applied to the controller 301. A MOSFET may be chosen by the total gate charge (RDS(ON)), power dissipation, package thermal impedance, cost, etc. A MOSFET optimized for high-frequency switching applications may be advantageous in some embodiments.

The LED 306 may be any LED known or convenient. In operation, the LED 306 may require high amplitude current to operate and may require and/or benefit from fast switching of the current. In some example embodiments, the LED 306 may be a string of LEDs. An input pin named ICOM to controller 301 is operable to adjust the amplitude of the current required to operate the LED.

Figure 4:
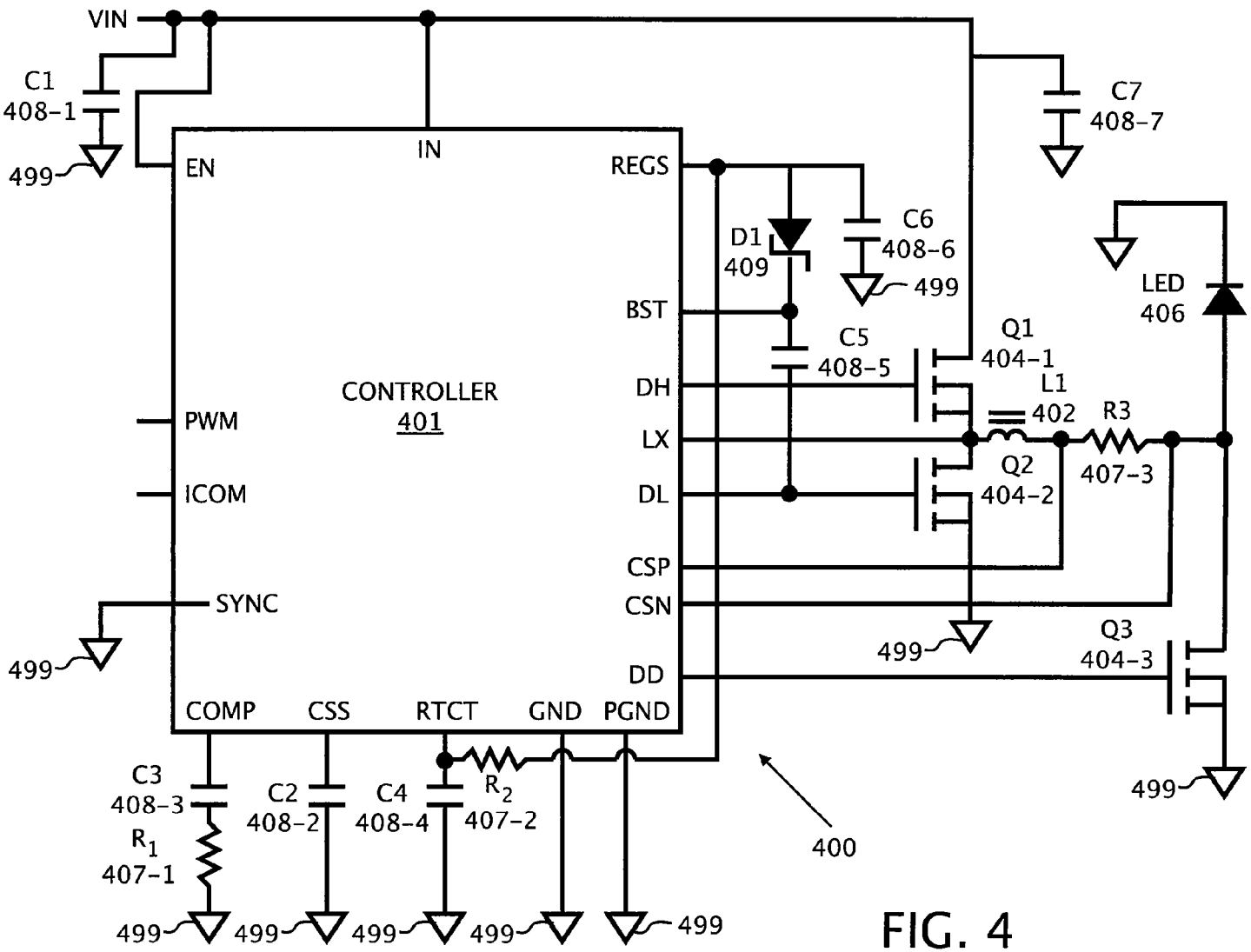
FIG. 4 is an exemplary diagram of a high current fast rise and fall time load driver according to one embodiment of the present invention.

FIG. 4 is an exemplary diagram of a high current fast rise and fall time load driver 400 according to one embodiment of the present invention. The load driver 400 includes a controller 401, an inductor 402, switching transistors—Q1 404-1, Q2 404-2, and Q3 404-3, a light emitting diode (LED) 406, resistors—R1 407-1, R2 407-2, R3 407-3, capacitors 408—C1 408-1, C2 408-2, C3 408-3, C4 408-4, C5 408-5, C6 408-6, a diode 409 and a ground 499.

The controller 401 includes at least the following pins PGN, GND, RTCT, CSS, COMP, SYNC, ICOM, PWM, EN, IN, REG5, BST, DH, LX, DL, CSP, CSN and DD. The DD pin is coupled to the switching transistor 404 and may activate the switching transistor 404, thereby controlling the switching of current from the inductor 402 away from the LED 406. The DD pin may control activation of the switching transistor 404 by the voltage value applied to the pin. The controller 401 may be implemented in any manner known or convenient, for example as an integrated circuit (IC), and in some example embodiments will include additional pins for increased functionality, while in others some pins may be omitted.

The inductor 402 may be any inductor known or convenient. The inductor 402 may control the ripple current and may oppose changes in current when charged, and thereby may provide a substantially stable current. The switching frequency, peak inductor current and allowable ripple at the output may determine the suitable inductance value and size of the inductor 402. In general, selecting higher switching frequencies reduces the inductance requirement of the inductor 402 but will result in a lower efficiency. The charging and discharging cycle of the inductor 402 and the drain capacities in the switching transistor 404 may create switching losses. Using lower switching frequencies may reduce switching losses.

The switching transistors 404 may be any combination of transistors known or convenient. In some exemplary embodiments, MOSFETs may be used for Q1 404-1, Q2 404-2, and Q3 404-3. The switching transistors 404 may operate as gates, allowing substantially zero current across the source and drain terminals when inactivate. If a MOSFET is used as Q1 404-3, input PWM from a control system to controller 401 is operable to control the ON and OFF sequence of 404-3 via the DD pin on controller 401, where DD may activate the MOSFET by the voltage applied on the gate terminal. Alternatively, the signal may come directly from the control system without first being applied to 401. Input ICOM to controller 401 is operable to adjust the amplitude of the current required to operate the LED. In some example embodiments, a MOSFET may be chosen by the total gate charge (RDS(ON)), power dissipation and package thermal impedance. In some example embodiments, it may be advantageous to choose a MOSFET optimized for high-frequency switching applications. The Q1 404-1 and Q2 404-2 may be controlled respectively by the voltages of the DH and DL pins of the controller 401.

The resistors 407 may be any combination of resistors known or convenient. The resistors 407 may be of any combination of resistance value, tolerance, and operating parameters as required for the driver and may depend on the values of the other components. Alternatively, this resistor can be placed between the common connection of the source of Q3 and LED cathode and the ground. This just makes it more convenient to sense the current flow and it is electrically equivalent to the connection method of FIG. 4. In some cases there maybe some capacitance added across the output to reduce the current ripple that flows through the LED.

The capacitors 408 may be any combination of capacitors known or convenient. The capacitors 408 may be of any combination of capacitance value, tolerance, and operating parameters as required for the driver 400 and may depend on the values of the other components.

The diode 409 may be any diode known or convenient. For example, in some example embodiments the diode 409 may be a zener or schottky diode. The diode 409 may be of any combination of operating parameters as required for the driver 400 and may depend on the values of the other components.

Figure 5:
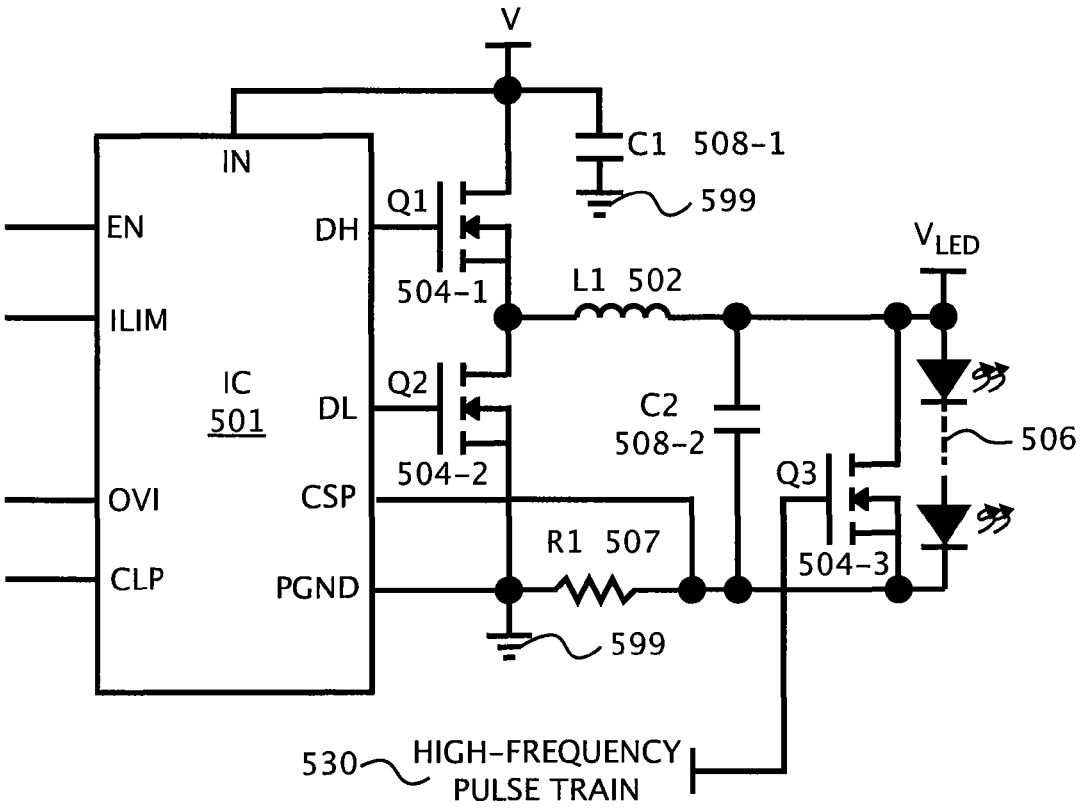
FIG. 5 is an exemplary diagram of a high current fast rise and fall time load driver according to one embodiment of the present invention.

FIG. 5 is an exemplary diagram of a high current fast rise and fall time load driver 500 according to one embodiment of the present invention. The load driver 500 includes an integrated circuit (IC) 501, a (buck) inductor 502, switching transistors—Q1 504-1, Q2 504-2, and Q3 504-3, a high amp load 506, a resistor 507, capacitors 508—C1 508-1, C2 508-2, and a ground 599. A control signal such as a high-frequency pulse train 530 can be used to control the switching transistor Q3 504-3.

The IC 501 includes the following pins PGN, CLP, OVI, ILIM, EN, IN, DH, DL, and CSP. The PGN pin may operate as a power-supply ground or as substantially equivalent to ground. The CLP pin may operate as a current-error amplifier output. The CLP pin may compensate the current loop by connecting an RC network to ground. The OVI pin may operate as an overvoltage protection. The OVI pin may be coupled to a difference amplifier coupled to the input and output terminals of the load 506, and if the difference output by the difference amplifier exceeds a predetermined value the DH and DL pin values are changed. The ILIM pin may operate as a current-limit setting input. The ILIM pin may be connected to ground through a resistor, and the resistance value of the resistor sets the "hiccup" current-limit threshold. The ILIM may be connected to the ground 599 through a capacitor to ignore output overcurrent pulses. The EN pin may operate as an output enable. The EN pin may be driven high or unconnected for normal operation mode. The EN pin may also be driven low to shut down the power drivers. The EN pin may also be connected ground through a capacitor to program a hiccup-mode duty cycle. The IN pin may operate as a supply voltage connection. The DH pin is coupled to the gate terminal on the Q1 504-1 and may operate as a high-side gate driver output for Q1 504-1. The DL pin is coupled to the gate terminal on the Q2 504-2 and may operate as a low-side gate driver output for Q2 504-2. The CSP pin may operate as a current-sense differential amplifier positive input. The differential voltage between the CSP and a negative voltage input may be amplified internally to measure the current from the inductor 502.

The inductor 502 may be any inductor known or convenient. The inductor 502 controls the ripple current and may oppose changes in currents when charged and thereby may provide a substantially stable current when charged. The switching frequency, peak inductor current and allowable ripple at the output of the inductor 502 may determine the inductance value and size of inductor 502. In general, selecting higher switching frequencies reduces the inductance requirement of the inductor 502 but will result in a lower efficiency. The charging and discharging cycle of the inductor 502 and the drain capacities in the Q3 504-3 may create switching losses. Lower switching frequencies may be used to reduce switching losses.

The switching transistors 504 may be any combination of transistors known or convenient. In some exemplary embodiments, a combination of MOSFETs and/or IGFETs may be used for Q1 504-1, Q2 504-2, and Q3 504-3. The MOSFETs may operate as gates, allowing substantially zero current across the source and drain terminals when inactivate and allowing substantially all current across the source and drain terminals when activated. If a MOSFET is used as Q3 504-3, the coupled pulse train 530 may activate the Q3 504-3 by changing a voltage on the gate terminal of Q3 504-3. A MOSFET may be chosen by the total gate charge (RDS (ON)), power dissipation and package thermal impedance. It may be advantageous to choose a MOSFET optimized for high-frequency switching applications. The Q1 504-1 and Q2 504-2 may be controlled by the voltages of the DH and DL pins, respectively, of the IC 501.

The resistor 507 may be any resistor known or convenient. The resistor 507 may be of any combination of resistance value, tolerance, and operating parameters as required for the driver 500 and may depend on the values of the other components. In some example embodiments resistor 507 operates so VI is not shorted to the ground 599.

The capacitors 508 may be any combination of capacitors known or convenient. The capacitors 508 may be of any combination of capacitance value, tolerance, and operating parameters as required for the driver 500 and may depend on the values of the other components.

In some example embodiments, the load driver 500 is in a basic buck topography where the inductor 502 is always connected to the high amp load 506. This design may minimize the current ripple by oversizing the inductor 502 and may allow for a very small output capacitor (C2 508-2). The Q3 504-3 may be activated and divert the current around the high amp load 506 at a very fast rate. The Q3 504-3 may also discharge an output capacitor (C2 508-2) and because the capacitance is so small the capacitor (C2 508-2) will not be stressed. In some example embodiments, the resistor 507 may sense the current and there is no reaction to the short that Q3 504-3 places the across the high amp load 506. The Q3 504-3 may need to dissipate the high amp load 506 current applied on the Q3 504-3 RDS(ON) at some maximum duty cycle. If the driver 500 needs to control very high currents switching transistors in parallel may be used.

Figure 6:
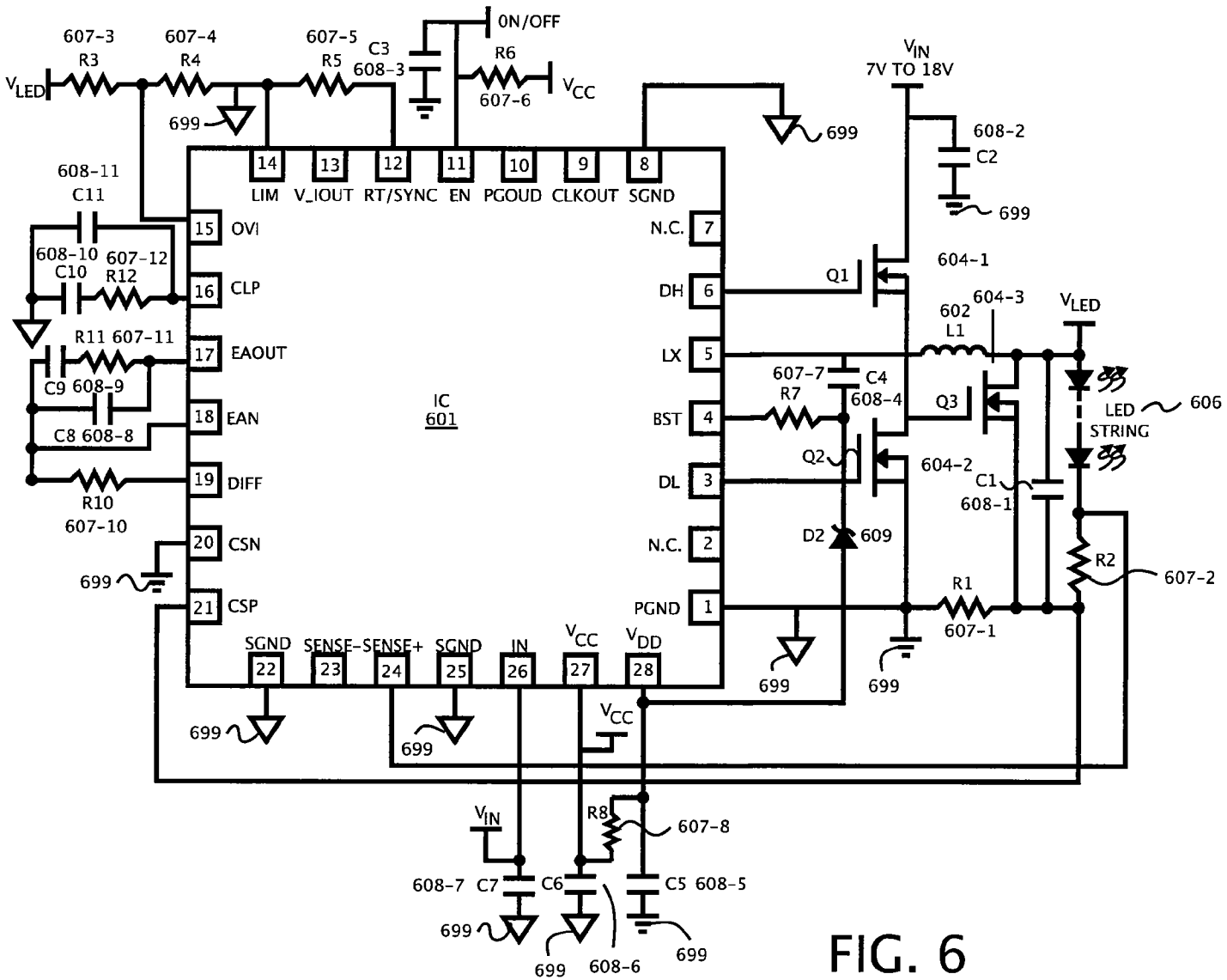
FIG. 6 is an exemplary diagram of a ground-referred buck-boost LED driver according to one embodiment of the present invention.

FIG. 6 is an exemplary diagram of a ground-referred buck-boost driver 600 according to one embodiment of the present invention. The LED driver 600 includes an integrated circuit (IC) 601, inductors 602, switching transistors 604—Q1 604-1, Q2 604-2, Q3 604-3, a light emitting diode (LED) string 606, resistors—R1 607-1, R2 607-2, R3 607-3, R4 607-4, R5 607-5, R6 607-6, R7 607-7, R8 607-8, R9 607-9, R10 607-10, R11 607-11, R12 607-12, capacitors 608—C1 608-1, C2 608-2, C3 608-3, C4 608-4, C5 608-5, C6 608-6, C7 608-7, C8 608-8, C9 608-9, C10 608-10, C11 608-11, a diode 609 and a ground 699.

The inductor 602 may be any inductor known or convenient. The inductor 602 controls the ripple current and may oppose changes in currents when charged and thereby may provide a substantially stable current when charged. The switching frequency, peak inductor current and allowable ripple at the output may determine the inductance value and size of inductor 602. In general, selecting higher switching frequencies reduces the inductance requirement of the inductor 602 but will result in a lower efficiency. The charging and discharging cycle of the inductor 602 and the drain capacities in the switching transistor 604 may create switching losses. Using lower switching frequencies may be used to reduce switching losses.

The switching transistors 604 may be any combination of transistors known or convenient. In some example embodiments, a MOSFET or IGFET may be used for Q3 604-3. The MOSFET will operate as gate, allowing substantially zero current across the source and drain terminals when inactivate. In some example embodiments, a MOSFET may be chosen by the total gate charge (RDS(ON)), power dissipation and package thermal impedance. In some example embodiments it may be advantageous to choose a MOSFET optimized for high-frequency switching applications. The Q1 604-1 and Q2 604-2 may be controlled respectively by the voltages of the DH and DL pins of the controller 601.

The resistors 607 may be any combination of resistors known or convenient. The resistors 607 may be of any combination of resistance value, tolerance, and operating parameters as required for the driver and may depend on the values of the other components.

The capacitors 608 may be any combination of capacitors known or convenient. The capacitors 608 may be of any combination of capacitance value, tolerance, and operating parameters as required for the driver 600 and may depend on the values of the other components.

In some example embodiments, the driver 600 may be in a buck/boost topography. During the on-time the current may flow from the input capacitor (C2 608-2), through the Q1 604-1, the L1 602-1, and the Q3 604-3 and back to the input capacitor. During the off-time current may flow up through the Q2 604-2, the inductor 602 and the diode 609 and to the output capacitor (C1 608-1). The driver 600 may allow the inductor 602 to reside between input and ground during the on-time and during the off-time and may allow the inductor 602-1 to reside between the ground 699 and the output capacitor (C1 608-1). This may allow the driver 600 to output voltage which may be any voltage less than, equal to, or greater than the input voltage.

Figure 7:
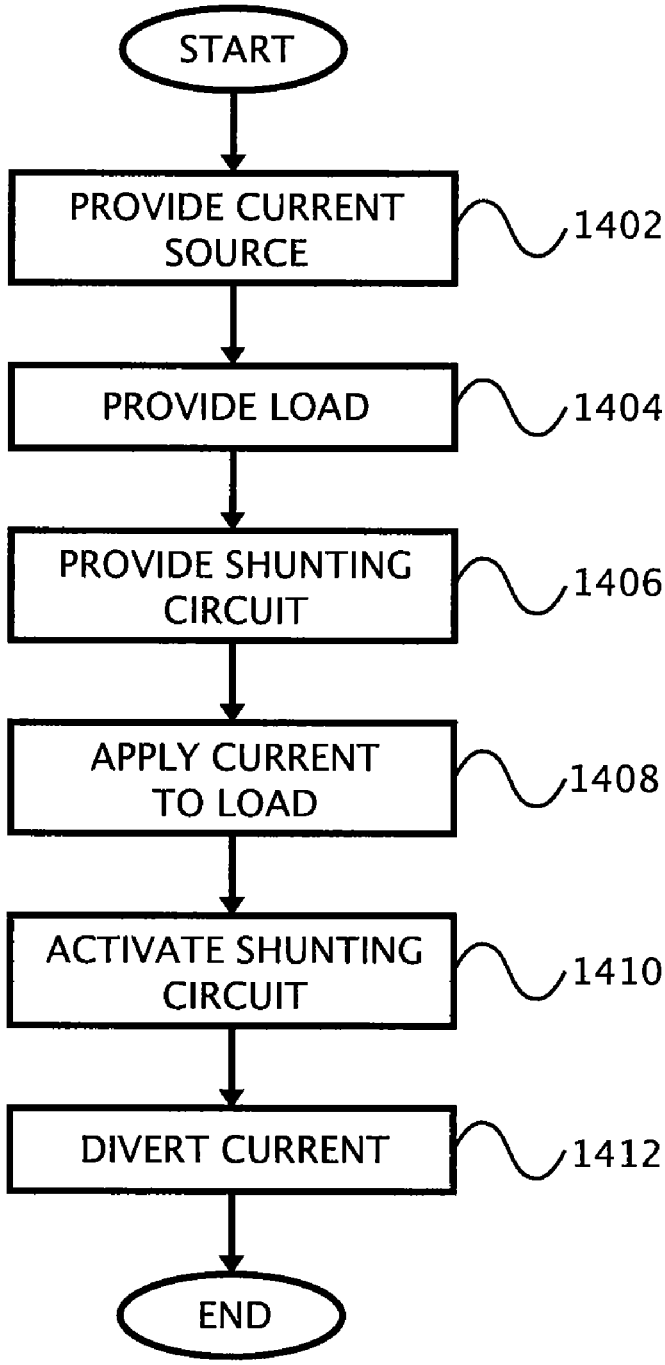
FIG. 7 is an exemplary block diagram of a method for fast switching of a high amplitude load.

FIG. 7 is an exemplary block diagram of a method for fast switching of a high amplitude load. Block 702 depicts providing a substantially constant high amplitude current source. Block 704 depicts providing a load. Block 706 depicts providing a shunting circuit. Block 708 depicts applying a high amplitude current to the load from the current source. Block 710 depicts activating the shunting circuitry. Block 712 depicts diverting the current away from the load by the shunting circuitry creating a low impedance connection.

As used herein, the term "embodiment" means an embodiment that serves to illustrate by way of example but not limitation.

It will be appreciated to those skilled in the art that the preceding examples and embodiments are exemplary and not limiting to the scope of the present invention. It is intended that all permutations, enhancements, equivalents, and improvements thereto that are apparent to those skilled in the art upon a reading of the specification and a study of the drawings are included within the true spirit and scope of the present invention. It is therefore intended that the following appended claims include all such modifications, permutations and equivalents as fall within the true spirit and scope of the present invention.

I claim:

1. A system comprising:

a current source providing a controlled current;

a load coupled to the current source so as to allow the current from the current source to drive the load;

one or more current shunting devices coupled to the current source configured to divert the current from the current source to ground, away from the entirety of the load; and a control signal operable to activate the one or more current shunting devices to direct the current to ground, wherein the control signal is received by the current source to activate the one or more current shunting devices.

2. A system as recited in claim 1, wherein the current source is an inductor.

3. A system as recited in claim 1, wherein the current source and its associated switching circuitry are kept at a substantially charged state.

4. A system as recited in claim 1, wherein the current shunting device includes a switch, wherein the switch is a low impedance metal oxide semiconductor field-effect transistor (MOSFET), a bipolar junction transistor (BJT), or an insulated-gate field-effect transistor (IGFET).

5. A system as recited in claim 1, wherein the load includes a light emitting diode (LED) or a string of LEDs.

6. A system as recited in claim 5, wherein the LED is configured to provide light suitable for use with one or more of a rear projection television and a front projector.

7. A system as recited in claim 1, wherein the system includes one or more of synchronous rectification and a free-wheeling diode.

8. A system as recited in claim 1, wherein the current shunting device is operable to divert at least a portion of the current from the current source away from the load when activated.

9. A system as recited in claim 1, wherein the current shunting device is operable to divert a first portion of the current from the current source away from the load when activated while a second portion continues to be directed to the load thereby adjusting an amount of current directed to the load.

10. A system comprising:

a controlling circuit including:

a current source providing a controlled current; and a current shunting device configured to divert the current from the current source to ground, away from the entirety of a load when activated and switch the current to the load when not activated;

an input signal input to the controlling circuit and configured to adjust an amplitude of the controlled current; and said load coupled to the current source so as to allow the current from the current source to drive the load.

11. A system as recited in claim 10, wherein the controlling circuit is an integrated circuit (IC).

12. A system as recited in claim 10, wherein the controlling circuit is operable to perform one or more of, activate the current shunting device, deactivate the current shunting device, and adjust the amplitude of the controlled current.

13. A system as recited in claim 10, wherein the load is configured to provide light suitable for use with one or more of a rear projection television and a front projector.

14. A circuit for fast switching of current to one or more light emitting diodes (LEDs) comprising:

one or more LEDs;

a voltage source;

an inductor having a first terminal and a second terminal, the second terminal of the inductor is coupled to the one or more LEDs;

a first switching metal oxide semiconductor field-effect transistor (MOSFET) having a first terminal, a second terminal and a third terminal, the first terminal of the first MOSFET coupled to the second terminal of the inductor and to the one or more LEDs;

a second MOSFET having a first terminal, a second terminal and a third terminal, the first terminal of the second MOSFET coupled to the voltage source, the third terminal of the second MOSFET coupled to the first terminal of the inductor;

a third MOSFET having a first terminal, a second terminal and a third terminal, the first terminal of the third MOSFET coupled to the third terminal of the second MOSFET and to the first terminal of the inductor, wherein the inductor is charged by the voltage source through the second MOSFET and the third MOSFET; and a control signal supplied to the second terminal of the first MOSFET and operable to activate the first MOSFET to shunt current to ground, away from the one or more LEDs, thereby causing the one or more LEDs to stop producing light.

15. A circuit as recited in claim 14, wherein:

the control signal comes from one or more of a first pin of an integrated circuit (IC) having configured to drive the second terminal of the first MOSFET and a control system.

16. A circuit as recited in claim 14, wherein:

the control signal is operable to activate the second MOSFET and thereby charge the inductor.

17. A circuit as recited in claim 14, wherein:

the control signal is operable to activate the third MOSFET and thereby charge the inductor.

18. A circuit as recited in claim 14, wherein the LED is configured to provide light suitable for use with one or more of a rear projection television and a front projector.

19. A system as recited in claim 14, wherein the third terminal of the third MOSFET is coupled to ground, and the third terminal of the first MOSFET is coupled to ground.

20. A method for fast switching of a load comprising:

(a) providing a substantially constant current source supplied by a voltage source, an inductor, a first switching metal oxide semiconductor field-effect transistor (MOSFET) and a second MOSFET, wherein the inductor has a first terminal and a second terminal, the second terminal of the inductor is coupled to the one or more LEDs, the first MOSFET has a first terminal, a second terminal and a third terminal, the first terminal of the first MOSFET is coupled to the voltage source and the third terminal of the first MOSFET is coupled to the first terminal of the inductor, and the second MOSFET has a first terminal, a second terminal and a third terminal, the first terminal of the second MOSFET is coupled to the third terminal of the first MOSFET and to the first terminal of the inductor, wherein the inductor is charged by the voltage source through the first MOSFET and the second MOSFET;

(b) providing the load coupled to the second terminal of the inductor;

(c) providing a shunting circuit coupled to the second terminal of the inductor;

(d) applying a current to the load from the current source;

(e) activating the shunting circuit; and (f) diverting the current away from the entire load to ground, by the shunting circuitry creating a low impedance connection.

21. A method as recited in claim 20, further comprising:

providing a high frequency pulse train; and wherein, the shunting circuitry is activated with the pulse train.

22. A method as recited in claim 20, further comprising:

one or more of deactivating the shunting circuitry, applying the current to the load, activating the shunting circuitry and diverting the current away from the load.

23. A method as recited in claim 20, further comprising:

configuring the load to provide light suitable for use with one or more of a rear projection television and a front projector.

24. A method for fast switching high current light emitting diodes (LEDs), characterized by controlling at a substantially constant current of an inductor coupled to the LEDs, and switching off the LEDs by shunting the inductor current through a low impedance switch to ground thereby diverting current away from the all of the LEDs, wherein the constant current is controlled by a driver circuit having switching elements coupled to the inductor, the driver circuit configured to appropriately charge the inductor.

25. A method as recited in claim 24, further comprising:

configuring the LEDs to provide light suitable for use with one or more of a rear projection television and a front projector.

26. A circuit for fast switching of current to one or more light emitting diodes (LEDs) comprising:

one or more LEDs;

a voltage source;

an inductor having a first terminal and a second terminal, the second terminal of the inductor is coupled to the one or more LEDs;

a first switching transistor having a first terminal, a second terminal and a third terminal, the first terminal of the first transistor coupled to the second terminal of the inductor and to the one or more LEDs;

a second transistor having a first terminal, a second terminal and a third terminal, the first terminal of the second transistor coupled to the voltage source, the third terminal of the second transistor coupled to the first terminal of the inductor;

a third transistor having a first terminal, a second terminal and a third terminal, the first terminal of the third transistor coupled to the third terminal of the second transistor and to the first terminal of the inductor, wherein the inductor is charged by the voltage source through the second transistor and the third transistor; and a control signal supplied to the second terminal of the first transistor and operable to activate the first transistor to shunt current to ground, away from the one or more LEDs, thereby causing the one or more LEDs to stop producing light.

* * * * *